United States Patent [19]

Lampietti

[11] 4,018,071

[45] Apr. 19, 1977

[54] SPRING WINDING MACHINE WITH IMPROVED PITCH MECHANISM

[75] Inventor: Bernard Pierre Lampietti, Goshen, Conn.

[73] Assignee: Torin Corporation, Torrington, Conn.

[22] Filed: Oct. 9, 1975

[21] Appl. No.: 621,209

[52] U.S. Cl. ..... 72/23; 72/142

[51] Int. Cl.[2] ..... B21F 3/04

[58] Field of Search ..... 72/23, 135, 138, 142; 140/71 R, 82; 318/71, 85

[56] References Cited

UNITED STATES PATENTS

| | | | |
|---|---|---|---|
| 1,050,363 | 1/1913 | Harter | 72/142 |
| 2,697,470 | 12/1954 | Sampatacos et al. | 72/23 |
| 2,788,807 | 4/1957 | Sampatacos et al. | 140/82 |
| 2,806,507 | 9/1957 | Stofko | 72/142 |
| 3,231,801 | 1/1966 | Lang | 318/85 X |
| 3,433,041 | 3/1969 | Cavagnero et al. | 72/138 |

*Primary Examiner*—C.W. Lanham
*Assistant Examiner*—E. M. Combs
*Attorney, Agent, or Firm*—McCormick, Paulding & Huber

[57] ABSTRACT

A spring winding machine comprising a rotary cam shaft, a cam mounted on the shaft and rotatable therewith, and a follower on a lever intermediate its ends and engaged and driven in one and an opposite direction by the cam during each cam rotation. The lever is pivotally supported at one end and an opposite end drives a first slide in one and an opposite direction. A rack on the slide rotates a pinion on one and an opposite direction which in turn drives an electrical spindle drive means. The drive means includes a direct current tachometer generator and a fast response servo controller and motor which rotates the spindle in one and an opposite direction to wind springs thereon. A manually adjustable potentiometer predetermines the number of spindle turns for each cam rotation and thus establishes the number of spring coils. A second slide movable in one and an opposite direction is driven from the first slide by means of an angularly adjustable guideway on the first slide and a follower on the second slide. Adjustment of the guideway occurs about a point on the centerline of movement of the second slide so that a constant reference or starting point is maintained. The second slide drives an oscillable lever which in turn drives a conventional pitch rod in one and an opposite direction. The pitch rod is connected by a yoke with the spindle for free relative rotation but for axial driving movement of the spindle by the rod. Thus, the amount or extent of spindle axial or pitch movement is determined by the angular adjustment of the guideway and a constant starting point is provided for to maintain a constant wire feed or pass line, spindle readjustment for each pitch setting being thus eliminated.

25 Claims, 4 Drawing Figures

SPINDLE DRIVE

SPRING WINDING MACHINE WITH IMPROVED PITCH MECHANISM

BACKGROUND OF THE INVENTION

Spring winding machines of the type commonly known as torsion winders are illustrated in U.S. Pat. No. to Sampatacos et al. 2,697,470, Sampatacos et al. U.S. Pat. No. 2,788,807, Cavagnero et al. U.S. Pat. No. 3,433,041 and in my co-pending application Ser. No. 618,169, filed on Sept. 30, 1975, jointly with George Yagusic and entitled "Electro-Mechanical Drive for Torsion Winders and the Like." Such machines have in the past been provided with adjustment means for preselecting the number of turns of a spring winding spindle for each rotation of the machine cam shaft. Further, the machines have ordinarily included an adjustable pitch mechanism for effecting axial or spring pitching movement of the spindle in timed relationship with the winding operation. While such machines have been found generally satisfactory, they have been somewhat lacking in the ease and convenience with which necessary winding and pitch adjustments can be effected.

SUMMARY OF THE INVENTION

It is the general object of the present invention to provide a spring winding machine of the type mentioned wherein a high degree of ease and convenience is provided for in effecting both winding and pitch adjustments, the pitch adjustment in particular being accomplished by a simple one-step operation.

DESCRIPTION OF THE PREFERRED EMBODIMENT

Figures 1, 2, 3, 4:
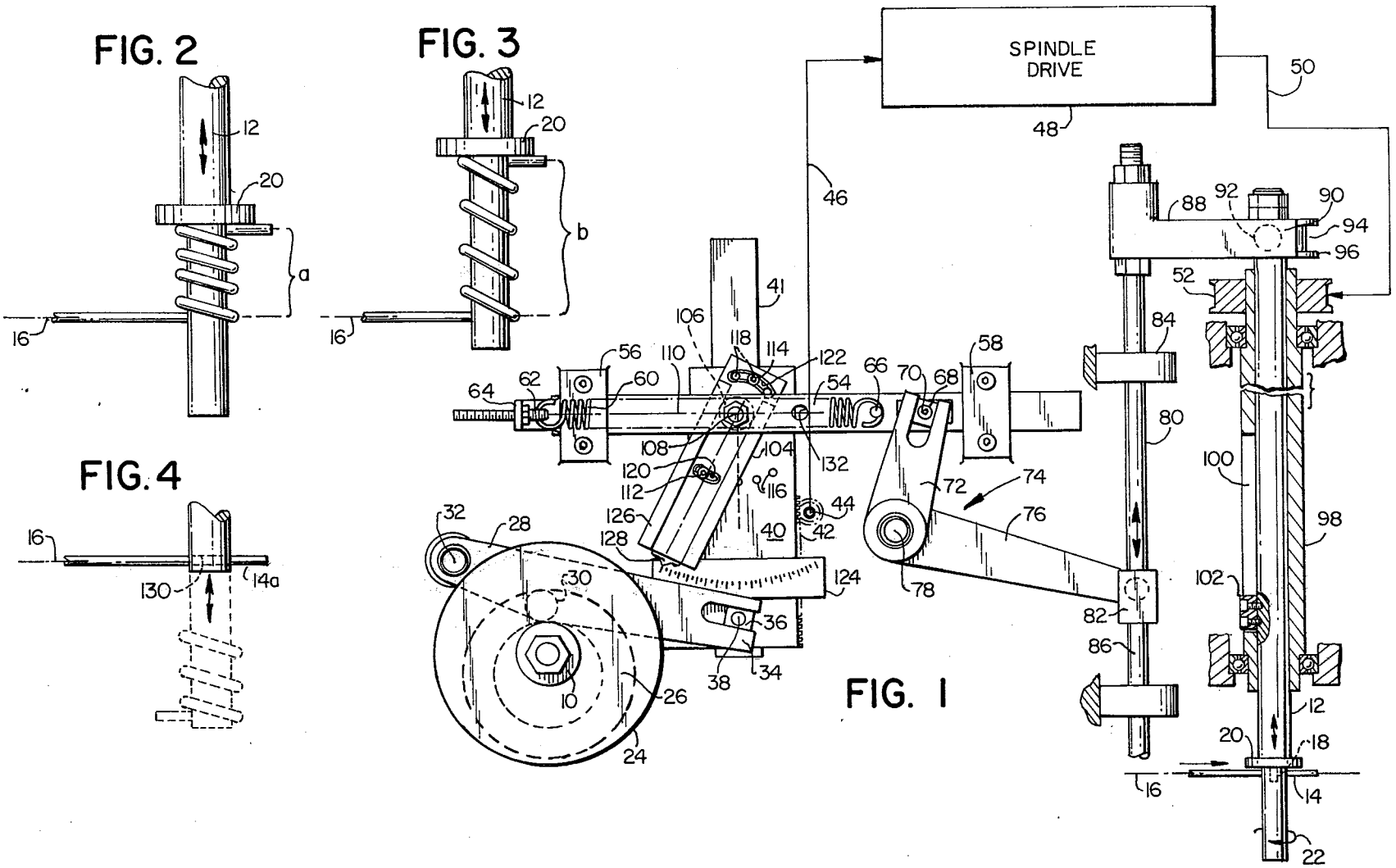
FIG. 1 is a schematic illustration of a portion of a spring winding machine constructed in accordance with the present invention.
FIG. 2 is a schematic illustration of a portion of the machine winding spindle and a spring wound thereon.
FIG. 3 is a further illustration of a portion of the machine spindle with a second and somewhat different spring wound thereon.
FIG. 4 is still another illustration of a portion of the machine spindle with an end across center spring wound thereon by downward spindle movement.

Referring particularly to FIG. 1, will be observed that a rotary cam shaft is provided, as indicated generally at 10, and may be regarded as a continuously rotating driven shaft adapted to effect and to control the intermittent winding of springs on a spindle 12. A leading end of spring wire 14 is advanced by a conventional feed mechanism along a horizontal feed or pass line 16 to a position shown in FIG. 1 adjacent the spindle 12. A small axial pin 18 spaced radially from the spindle on an opposite side of the wire 14 and supported by a collar 20 provides for winding of the wire about the spindle lower end portion or arbor as the same is rotated in the direction indicated by the small arrow 22. Simultaneously, and as the spindle or arbor is rotated to wind the spring thereon an axial or pitch movement of the spindle must be effected to provide the desired pitch of the spring. Springs with varying numbers of turns or coils may be required and pitch requirements may also vary over a wide range. Thus, both winding and pitch adjustability is essential.

In FIG. 2 a spring having five turns or coils is illustrated and an axial or pitch movement of the spindle 12 over a distance a is required. In FIG. 3 a similar five turn or coil spring is illustrated but a substantially larger axial or pitch movement of the spindle is required as illustrated by a dimension b. Further, both winding and pitch adjustability are of course required when both the number of turns and the pitch is varied. Springs of the opposite hand are also required and it will thus be apparent that spindle winding movement may be required in a downward direction from the feed or pass line 16. With either upward or downward spindle axial movement, and on completion of the spring, the spindle must return to its reference or starting point as illustrated in FIG. 1 for receipt of a next succeeding leading end of wire 14. Thus, adjustment of the extent of spindle axial or pitch movement must be accomplished while maintaining a fixed or constant starting point for the spindle.

Returning now to the cam shaft 10, it will be observed that a cam 24 mounted thereon has a track 26 preferably cut to provide substantially harmonic motion. A follower means associated with the cam 24 comprises a lever 28 carrying a follower 30 engaged in the cam track 26 and moved arcuately in one and an opposite direction during each rotation of the cam or, during each cycle of machine operation. The lever 28 is pivotally supported at 32 and an opposite end portion thereof at 34 is bifurcated and receives a small block 36 pivotally mounted at 38 on a first slide 40.

The slide 40 is mounted on a guideway 41 for vertical sliding movement in one and an opposite direction and, said slide forms one element of a first motion transmitting means of the invention. The slide 40 has two outputs as shown and has mounted along a right hand side thereof a vertical rack 42. The rack 42 has associated therewith a pinion 44 which is rotated thereby in one and an opposite direction on similar movement of the slide 40 at the urging of the cam lever 28.

The rack and pinion 42, 44 provide a first output of the first motion transmitting means and such output is illustrated schematically by a line 46 extending to a spindle drive means at 48. The spindle drive means 48 is preferably of the type illustrated and described in my aforementioned copending application and includes a direct current tachometer generator receiving the rotary mechanical input from the pinion 44. The tachometer generator in turn operates a fast response servo motor through an associated amplifier and controller and the motor rotatably drives the spindle 12 as illustrated schematically by the line 50 extending to a belt pulley 52 fixed atop the spindle. A manually adjustable potentiometer provides for a simple and convenient one-step adjustment of the number of turns completed by the winding spindle 12 during each machine cycle or rotation of the cam 10. That is, a preselected number of turns of the winding spindle is effected in one and an opposite direction by the servo motor as determined by appropriate adjustment of the potentiometer. Thus, a desired number of spring coils or convolutions can be readily preselected.

A second output of the first motion transmitting means of the present invention comprises a spring pitch movement passed to a second motion transmitting means. The second motion transmitting means includes a second slide 54 movable in one and an opposite direction in guides 56, 58 and arranged horizontally and at right angles with respect to the first slide 40. A counterbalancing tension spring 60 fixedly attached at one end by means of an eyebolt 62 secured to the machine frame by a bracket 64 has an opposite end portion engaged with a pin 66 on the slide 54. As will be seen hereinbelow, the counterbalancing spring 60 biases the slide 54 leftwardly and in a direction opposite to the effect of gravity on the spindle 12 and an associated pitch rod. At a right hand portion, a small block 68 pivotally supported at 70 on the slide 54 is received in a bifurcated end portion of a first arm 72 of an L-shaped oscillable lever 74 having a second arm 76. The lever 74 is pivotally supported on a machine frame at 78 and a right hand end portion of the arm 76 thereof is pivotally attached to a vertical pitch rod 80 by means of a small block and pin 82. The pitch rod 80 is supported by upper and lower brackets or guides 84, 86 for vertical sliding movement in one and an opposite direction and for transmitting axial or pitch movement to the spindle 12.

At an upper end portion, the pitch rod 80 has attached thereto one end portion of a yoke 88. The yoke 88 extends horizontally therefrom to an opposite and bifurcated end portion 90 which carries a pair of small rollers 92, one shown. The rollers 92 enter a suitable groove 94 in a collar 96 fixed at an upper end portion of the spindle 12. Thus, it will be apparent that the pitch rod 80 and the spindle 12 are interconnected for free relative rotation, but the pitch rod is operable to raise and lower the spindle 12 and thereby to effect axial or pitch movements thereof at the urging of the oscillable lever 74. The spindle 12 is slidable within a spindle sleeve 98 which carries the aforementioned drive pulley 52 and which has an elongated vertical slot 100. A small block 102 fixed to the spindle 12 slides in the slot 100 during axial movement of the spindle 12 and rotatably drives the spindle from the spindle sleeve 98 and the drive pulley 52.

In accordance with the invention, a driving connection is effected between the first and second motion transmitting means by an adjustable device adapted to provide for preselection of the extent of axial or pitch movement of the spindle 12. The said device preferably includes a guideway or sine bar 104 and a follower 106, the said elements being preferably mounted as shown, respectively on the first and second slides 40 and 54. The guideway 104 is angularly adjustable for preselection of the extent or degree of axial or pitch movement of the spindle 12. Preferably, and as illustrated the said guideway is angularly adjustable about a point 108 disposed on a horizontal centerline 110 of the line of movement of the slide 54. The guideway 104 may be secured in adjusted position by various means but a pair of binder screws 112, 114 are presently preferred. Each of the screws 112, 114 is associated with an arcuate series of small threaded openings in the machine frame, a series of openings 116 being provided for the screw 112 and a series of openings 118 for the screw 114. A small arcuate slot 120 in the guideway and associated with the screw 112 accommodates minor adjustments of the guideway about the point 108, the screw 112 being selectively entered in the openings 116, 116 for adjustments of larger magnitude. Similarly, an arcuate slot 122 associated with binder screw 114 accommodated accurate minor adjustment and major adjustments are accomplished by repositioning the screw 114 in a selected threaded opening 118.

From the foregoing, it will be apparent that the starting or reference point or position or the slide 54 is maintained constant with the guideway 104 mounted for angular adjustment about the point 108 on the centerline 110. Accordingly, the vertical starting or reference position of the spindle 12 is maintained constant irrespective of the extent or degree of adjustment of the axial or pitch movement of the spindle. A constant feed or pass line 16 is thus provided for and no additional spindle adjustment is required. Thus, a simple and convenient single-step winding adjustment is provided by the potentiometer in the electrical drive means 48 and a similar simple and convenient single-step pitch adjustment is provided for by the guideway or sine bar 104 swingable about the point 108.

There is preferably also provided for cooperation with the guideway 104 a scale 124 mounted adjacent its swingably adjustable end portion 126 and which may be conveniently calibrated in inches of spindle travel. A pointer 128 at the end portion 126 of the guideway 104 cooperates with the scale 124 for further convenience in pitch adjustment.

When it is necessary or desirable to move the spindle downwardly during winding as in FIG. 4, as for example in producing an end across center spring, the starting or reference point is again maintained constant but with a conventionally slotted spindle **12*a* positioned upwardly from the FIG. 1 position. The wire 14*a* is fed through a spindle slot 130 along the constant pass or feed line 16. The pivot 108 of the guideway 104 is moved to an opening 132 in the slide 54 and the counterbalance spring 60 may be removed. The guideway is also repositioned to incline upwardly and to the left by relocating the binder screws 112 and 114. Operation of the machine may then be effected as above but in an opposite sense to generate an end across center spring as illustrated in FIG. 4.**

I claim:

1. In a spring winding machine or the like, the combination comprising a rotary cam shaft, a cam mounted thereon and rotatable therewith, cam follower means operatively associated with the cam and moved in one and an opposite direction by the cam during each cam rotation, a first motion transmitting means connected with and driven by said follower means and having an output movement in one and an opposite direction, a spring winding spindle mounted both for rotation for winding springs and for axial movement for pitching the same, electrical spindle drive means connected with and receiving said output movement from said first motion transmitting means and operable to rotate said spindle in one and an opposite direction in response thereto, said electrical means including a first manual adjustment means for preselecting the number of spindle turns for each rotation of said cam shaft, a second motion transmitting means including a slide connected between said first motion transmitting means and said spindle and operable to effect axial spindle movement in one and an opposite direction in response to said output movement of said first motion transmitting means, and a second manual adjustment means including a guideway mounted on said first motion transmitting means and angularly adjustable about a point on a centerline of movement of said slide and a follower on said slide, said second adjustment means preselecting the extent of spindle axial or pitch movement during each cam rotation and being operable to maintain a constant axial starting position of said spindle irrespective of the extent of axial spindle movement.

2. The combination in a spring winding machine as set forth in claim 4 wherein said first motion transmitting means includes a slide movable in one and an opposite direction and arranged at right angles with respect to the slide in said second motion transmitting means, said guideway being adjustably mounted on said slide in said first motion transmitting means.

3. The combination in a spring winding machine as set forth in claim 2 wherein said first motion transmitting means includes a rack and pinion with the former mounted on the movable with said slide and the latter driven thereby in one and an opposite rotary direction and providing the aforementioned output movement to said electrical spindle drive means.

4. The combination in a spring winding machine as set forth in claim 2 wherein a scale is provided adjacent a swingably adjustable end portion of said guideway and cooperates therewith to indicate the extent of angular guideway adjustment and the resulting adjustment in the extent of spindle axial movement.

5. The combination in a spring winding machine as set forth in claim 2 wherein said second motion transmitting means includes an oscillable lever connected with and driven by said slide and an axially movable pitch rod connected with driven by said lever, the pitch rod in turn being connected for free relative rotation but in axial driving relationship with the spindle.

6. The combination in a spring winding machine as set forth in claim 5 wherein said cam follower means comprises a pivotally supported lever carrying a follower engaged with the cam, said lever also being connected in driving relationship with said slide in said first motion transmitting means.

7. The combination in a spring winding machine as set forth in claim 6 wherein a counterbalancing spring is provided to bias said slide in said second motion transmitting means in a direction opposite to the effect of gravity on said pitch rod and spindle.

8. In a spring winding machine or the like, the combination comprising a rotary cam shaft, a cam mounted thereon and rotatable therewith, cam follower means operatively associated with the cam and moved in one and an opposite direction by the cam during each cam rotation, a first slide connected with and driven by said follower means and having an output movement in one and an opposite direction, a spring winding spindle mounted both for rotation for winding springs and for axial movement for pitching the same, electrical spindle drive means responsive to said slide movement and operable to rotate said spindle in one and an opposite direction in response thereto, said electrical means including a first manual adjustment means for preselecting the number of spindle turns for each rotation of said cam shaft, a second slide connected with said spindle and operable to effect axial spindle movement in one and an opposite direction, a guideway and follower means connected between said first and second slides and operable to drive said second slide in one and an opposite direction in response to movement of said first slide in one and an opposite direction, said guideway being mounted for angular adjustment whereby to effect adjustment of the extent of movement of said second slide in one and an opposite direction and thus to adjust the extent of axial spindle movement in one and an opposite direction.

9. The combination in a spring winding machine as set forth in claim 8 wherein said first slide has associated therewith a rack and pinion with the former mounted on and movable with said slide and the latter driven thereby in one and an opposite rotary direction and providing the aforementioned output movement to said electrical spindle drive means.

10. The combination in a spring winding machine as set forth in claim 8 wherein said first and second slides are right angularly arranged, and wherein said guideway and follower are mounted respectively thereon.

11. The combination in a spring winding machine as set forth in claim 10 and including an oscillable lever connected with and driven by said second slide and an axially movable pitch rod connected with and driven by said lever, the pitch rod in turn being connected for free relative rotation but in axial driving relationship with the spindle.

12. The combination in a spring winding machine as set forth in claim 11 wherein said cam follower means comprises a pivotally supported lever carrying a follower engaged with the cam, said lever also being connected in driving relationship with said first slide.

13. The combination in a spring winding machine as set forth in claim 12 wherein said guideway is adjustable about a point on a centerline of movement of said second slide.

14. The combination in a spring winding machine as set forth in claim 13 wherein a scale is provided adjacent a swingably adjustable end portion of said guideway and cooperates therewith to indicate the extent of angular guideway adjustment and the resulting adjustment in the extent of spindle axial movement.

15. The combination in a spring winding machine as set forth in claim 14 wherein a counterbalancing spring is provided to bias said second slide in a direction opposite to the effect of gravity on said pitch rod and spindle.

16. In a spring winding machine or the like, the combination comprising a rotary cam shaft, a cam mounted thereon and rotatable therewith, cam follower means operatively associated with the cam and moved in one and an opposite direction by the cam during each cam rotation, a first motion transmitting means connected with and driven by said follower means and having an output movement in one and an opposite direction, a spring winding spindle mounted both for rotation for winding springs and for axial movement for pitching the same, electrical spindle drive means connected with and receiving said output movement from said first motion transmitting means and operable to rotate said spindle in one and an opposite direction in response thereto, said electrical spindle drive means comprising a fast response high gain servo controller and motor capable of high positive and negative accelerations on the order of 1000 RPM per 50 milliseconds, and said electrical means including a first manual adjustment means for preselecting the number of spindle turns for each rotation of said cam shaft, a second motion transmitting means connected between said first motion transmitting means and said spindle and operable to effect axial spindle movement in one and an opposite direction in response to said output movement of said first motion transmitting means, and a second manual adjustment means for preselecting the extent of spindle axial or pitch movement during each cam rotation, said second adjustment means being operable to maintain a constant axial starting position of said spindle irrespective of the extent of axial spindle movement.

17. The combination in a spring winding machine as set forth in claim 16 wherein said second motion transmitting means includes a slide movable in one and an opposite direction, and wherein said second manual adjustment means includes an adjustable device interconnecting said slide and said first motion transmitting means, said device serving to maintain a constant starting point for said slide irrespective of its adjusted position whereby to maintain said constant spindle starting position.

18. The combination in a spring winding machine as set forth in claim 17 wherein said adjustable interconnecting device comprises a guideway and a follower movable therealong, said guideway being angularly adjustable about a point on a centerline of movement of said slide whereby the extent of said slide movement in one and an opposite direction is rendered adjustable from a constant starting point.

19. The combination in a spring winding machine as set forth in claim 18 wherein said guideway is adjustably mounted on said first motion transmitting means, and wherein said follower is mounted on said slide.

20. The combination in a spring winding machine as set forth in claim 19 wherein said first motion transmitting means includes a slide movable in one and an opposite direction and arranged at right angles with respect to the slide in said second motion transmitting means, said guideway being adjustably mounted on said slide in said first motion transmitting means.

21. The combination in a spring winding machine as set forth in claim 20 wherein said first motion transmitting means includes a rack and pinion with the former mounted on and movable with said slide and the latter driven thereby in one and an opposite rotary direction and providing the aforementioned output movement to said electrical spindle drive means.

22. The combination in a spring winding machine as set forth in claim 20 wherein a scale is provided adjacent a swingably adjustable end portion of said guideway and cooperates therewith to indicate the extent of angular guideway adjustment and the resulting adjustment in the extend of spindle axial movement.

23. The combination in a spring winding machine as set forth in claim 20 wherein said second motion transmitting means includes an oscillable lever connected with and driven by said slide and an axially movable pitch rod connected with and driven by said lever, the pitch rod in turn being connected for free relative rotation but in axial driving relationship with the spindle.

24. The combination in a spring winding machine as set forth in claim 23 wherein said cam follower means comprises a pivotally supported lever carrying a follower engaged with the cam, said lever also being connected in driving relationship with said slide in said first motion transmitting means.

25. The combination in a spring winding machine as set forth in claim 24 wherein a counterbalancing spring is provided to bias said slide in said second motion transmitting means in a direction opposite to the effect of gravity on said pitch rod and spindle.

* * * * *

UNITED STATES PATENT OFFICE

CERTIFICATE OF CORRECTION

Patent No. 4,018,071 Dated April 19, 1977

Inventor(s) Bernard Pierre Lampietti

It is certified that error appears in the above-identified patent and that said Letters Patent are hereby corrected as shown below:

Column 3, Line 64:
"accommodated" should be --accommodates--.

Column 3, Line 68:
"or the slide" should be --of the slide--.

Column 4, Line 28:
"pivot 108" should be --pivot point 108--.

Column 5, Line 2:
"claim 4" should be --claim 1--.

Column 8, Line 13:
"extend" should be --extent--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*